US010376804B2

(12) United States Patent
Lu

(10) Patent No.: US 10,376,804 B2
(45) Date of Patent: Aug. 13, 2019

(54) MAGNETIC POSITIONING LIGHT-EMITTING TOY BLOCK

(71) Applicant: Shao-Chun Lu, Taoyuan (TW)

(72) Inventor: Shao-Chun Lu, Taoyuan (TW)

( * ) Notice: Subject to any disclaimer, the term of this patent is extended or adjusted under 35 U.S.C. 154(b) by 47 days.

(21) Appl. No.: 15/253,434

(22) Filed: Aug. 31, 2016

(65) Prior Publication Data

US 2018/0056205 A1 Mar. 1, 2018

(51) Int. Cl.

| | |
|---|---|
| ***A63H 33/04*** | (2006.01) |
| ***A63H 33/26*** | (2006.01) |
| ***A63H 33/08*** | (2006.01) |
| ***F21V 33/00*** | (2006.01) |
| ***F21V 23/06*** | (2006.01) |
| ***F21V 23/00*** | (2015.01) |
| ***F21L 4/02*** | (2006.01) |

(52) U.S. Cl.

CPC ..... *A63H 33/046* (2013.01); *A63H 33/042* (2013.01); *A63H 33/08* (2013.01); *A63H 33/26* (2013.01); *F21L 4/02* (2013.01); *F21V 23/001* (2013.01); *F21V 23/06* (2013.01); *F21V 33/008* (2013.01)

(58) Field of Classification Search

None

See application file for complete search history.

(56) References Cited

U.S. PATENT DOCUMENTS 3,237,341 A * 3/1966 Janning ..... F21S 9/02 273/238
3,696,548 A * 10/1972 Teller ..... A63H 33/042 446/91
5,833,465 A * 11/1998 Jarzewiak ..... G09B 1/36 434/171
6,024,626 A * 2/2000 Mendelsohn ..... A63H 33/046 446/124
6,241,249 B1 * 6/2001 Wang ..... A63F 9/1204 273/156
6,256,914 B1 * 7/2001 Yeh ..... A45C 1/12 40/711
7,322,873 B2 * 1/2008 Rosen ..... A63H 33/042 446/124
8,376,807 B2 * 2/2013 Fogarty ..... A63H 33/26 446/369

(Continued)

FOREIGN PATENT DOCUMENTS

CA 2774756 A1 * 2/2012 ..... A63H 33/086

*Primary Examiner* — John E Simms, Jr.
*Assistant Examiner* — Urszula M Cegielnik

(57) ABSTRACT

A magnetic positioning light-emitting toy block includes a body, a light source mounted in the body, and an electrical conduction mechanism mounted in the body and including magnetic conducting columns extended out of one side of the body and electrically connected to the light sources and conducting plates extended out of an opposite side of the body and electrically connected to the light source. Thus, when inserting the magnetic conducting columns of one magnetic positioning light-emitting toy block into the body of another magnetic positioning light-emitting toy block, the magnetic conducting columns of one magnetic positioning light-emitting toy block are secured to the conducting plates of the other magnetic positioning light-emitting toy block by magnetic attraction and simultaneously electrically connected thereto.

5 Claims, 9 Drawing Sheets

(56) References Cited

U.S. PATENT DOCUMENTS

| | | | | |
|---|---|---|---|---|
| 8,851,953 | B2 * | 10/2014 | Oschuetz | A63H 33/042 446/124 |
| 9,016,902 | B1 * | 4/2015 | Lin | F21S 2/005 362/249.01 |
| 2007/0147028 | A1 * | 6/2007 | Chan | A47G 33/06 362/123 |
| 2007/0184722 | A1 * | 8/2007 | Doherty | A63H 33/042 439/638 |
| 2010/0038850 | A1 * | 2/2010 | Tenorio | A63F 9/1208 273/153 S |
| 2013/0109267 | A1 * | 5/2013 | Schweikardt | A63H 33/04 446/85 |
| 2013/0217295 | A1 * | 8/2013 | Karunaratne | A63H 33/086 446/124 |
| 2013/0343025 | A1 * | 12/2013 | Bdeir | H01R 13/6205 361/803 |
| 2014/0349544 | A1 * | 11/2014 | Chien | A63H 33/042 446/91 |
| 2015/0251104 | A1 * | 9/2015 | Lange | A63H 33/042 446/92 |
| 2016/0030854 | A1 * | 2/2016 | Shaanti | A63H 33/042 446/85 |
| 2016/0361662 | A1 * | 12/2016 | Karunaratne | A63H 33/042 |
| 2017/0291116 | A1 * | 10/2017 | MacDonald | A63H 33/042 |

* cited by examiner

MAGNETIC POSITIONING LIGHT-EMITTING TOY BLOCK

BACKGROUND OF THE INVENTION

1. Field of the Invention

The present invention relates to toy blocks, and more particularly to a magnetic positioning light-emitting toy block, which has an electrical conduction mechanism mounted therein so that when two same magnetic positioning light-emitting toy blocks are connected together by magnetic attraction, they are electrically conducted.

2. Description of the Related Art

Regular toy blocks commonly have a connection structure for allowing multiple toy blocks to be connected to one another. Further, various light-emitting toy block designs are known. A light-emitting toy block has a light source mounted therein and provides an electric connection mechanisms so that when two light-emitting toy blocks are attached together, the electric connection mechanisms of the two light-emitting toy blocks are electrically conducted. However, conventional light-emitting toy blocks are still not satisfactory in function due to the drawback of complicated structure and manufacturing process.

SUMMARY OF THE INVENTION

The present invention has been accomplished under the circumstances in view. It is therefore the main object of the present invention to provide a magnetic positioning light-emitting toy block, which has an electrical conduction mechanism mounted therein and is so configured that two same magnetic positioning light-emitting toy blocks connectable to each other by magnetic attraction and automatically electrically conducted by means of the respective electrical conduction mechanisms when they are connected by magnetic attraction, thus, the magnetic positioning light-emitting toy block has the characteristics of simple structure and ease of production and application.

To achieve this and other objects of the present invention, a magnetic positioning light-emitting toy block comprises a body, a light source and an electrical conduction mechanism. The body comprises an accommodation chamber defined therein, a plurality of positioning holes located on one side thereof and a plurality of plug holes located on other sides thereof. The light source is mounted in the accommodation chamber of the body, comprising an electrical substrate and a light-emitting device electrically bonded to the electrical substrate. The electrical conduction mechanism comprises a plurality of magnetic conducting columns and a plurality of conducting plates. Each magnetic conducting column has one end thereof electrically connected to the electrical substrate of the light source, and an opposite end thereof inserted through one respective positioning hole of the body and extended out of the body. Each conducting plate comprises a conducting portion. The conducting plates are mounted in the accommodation chamber inside the body and electrically connected to the electrical substrate with the conducting portions thereof respectively aimed at the plug holes of the body. Thus, two same magnetic positioning light-emitting toy blocks are connectable by inserting the magnetic conducting columns of one magnetic positioning light-emitting toy block into the respective plug holes of the other magnetic positioning light-emitting toy block, enabling the inserted magnetic conducting columns to be connected to the conducting plates of the other magnetic positioning light-emitting toy block and electrically connected thereto.

DETAILED DESCRIPTION OF THE PREFERRED EMBODIMENT

Figure 1:
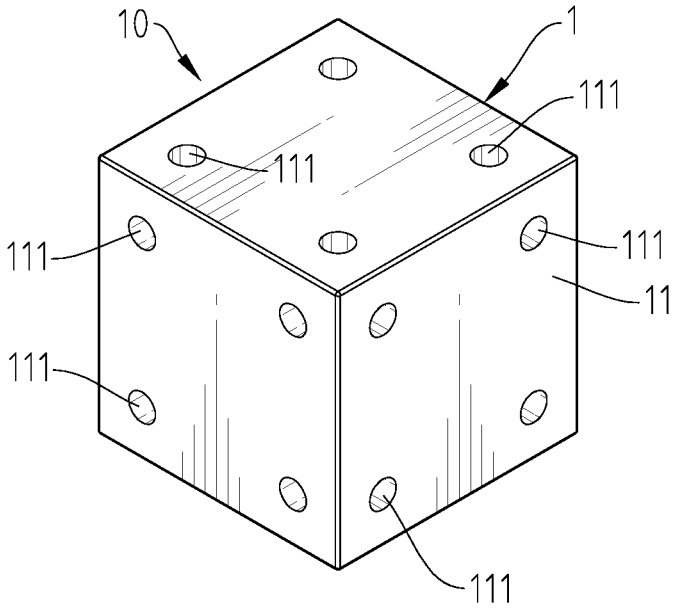
FIG. 1 is an oblique top elevational view of a magnetic positioning light-emitting toy block in accordance with the present invention.
Figure 2:
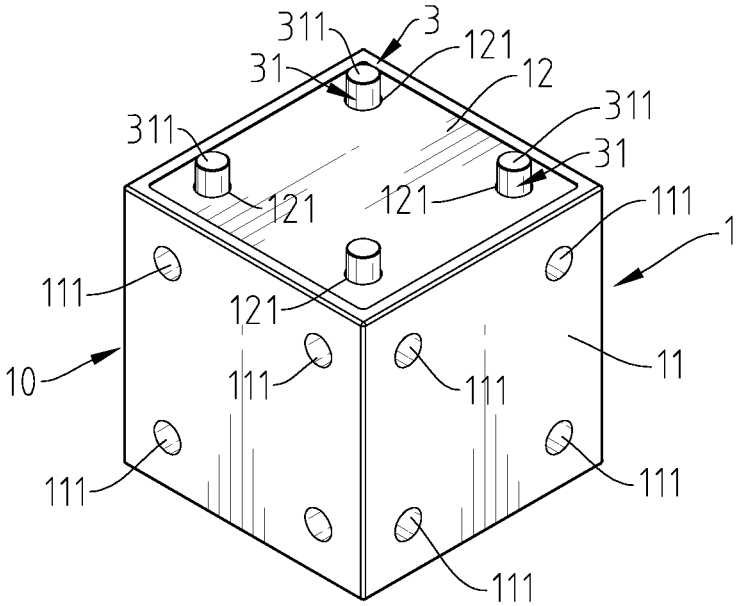
FIG. 2 is an oblique bottom elevational view of the magnetic positioning light-emitting toy block in accordance with the present invention.
Figure 3:
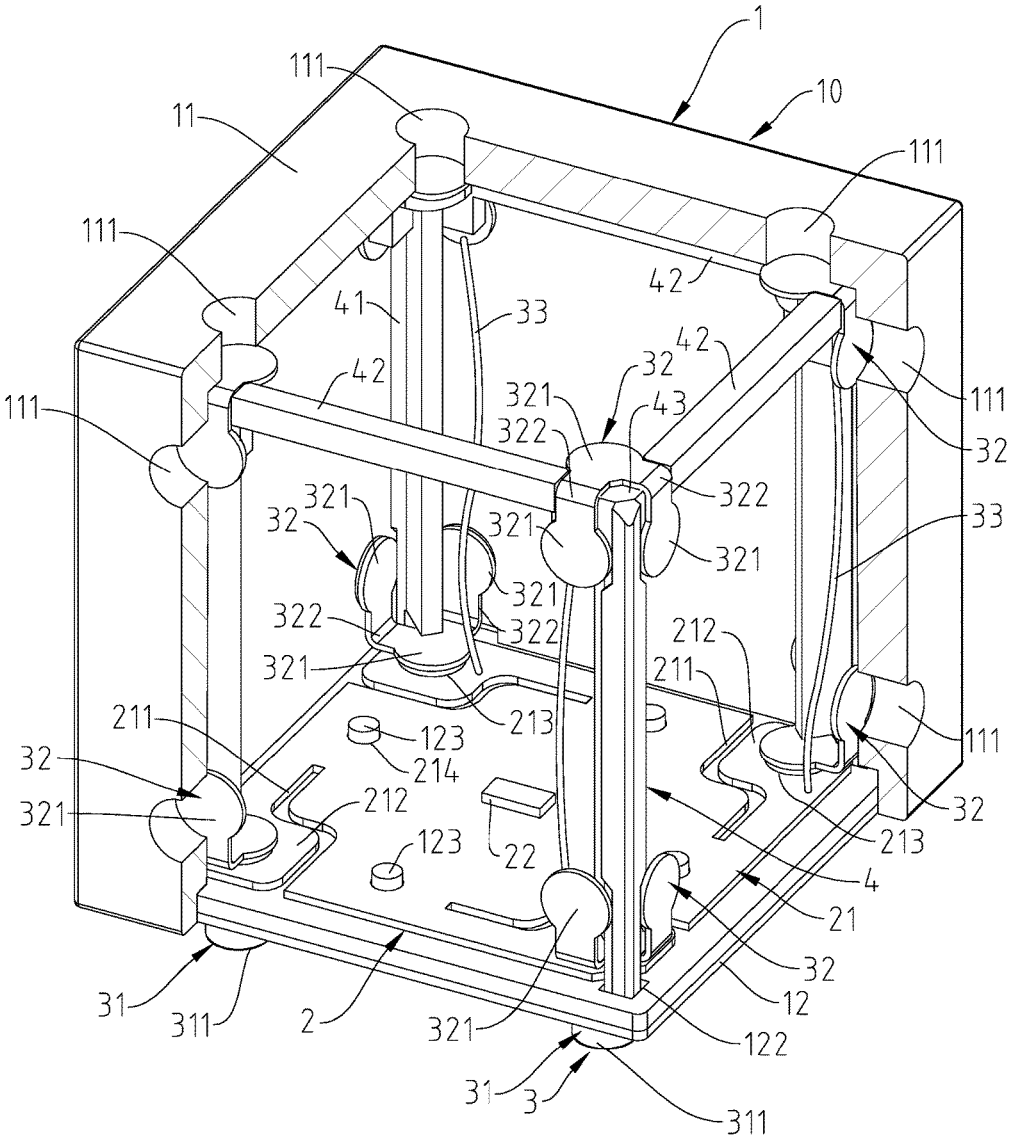
FIG. 3 is a partial sectional elevational view of the magnetic positioning light-emitting toy block in accordance with the present invention.
Figure 4:
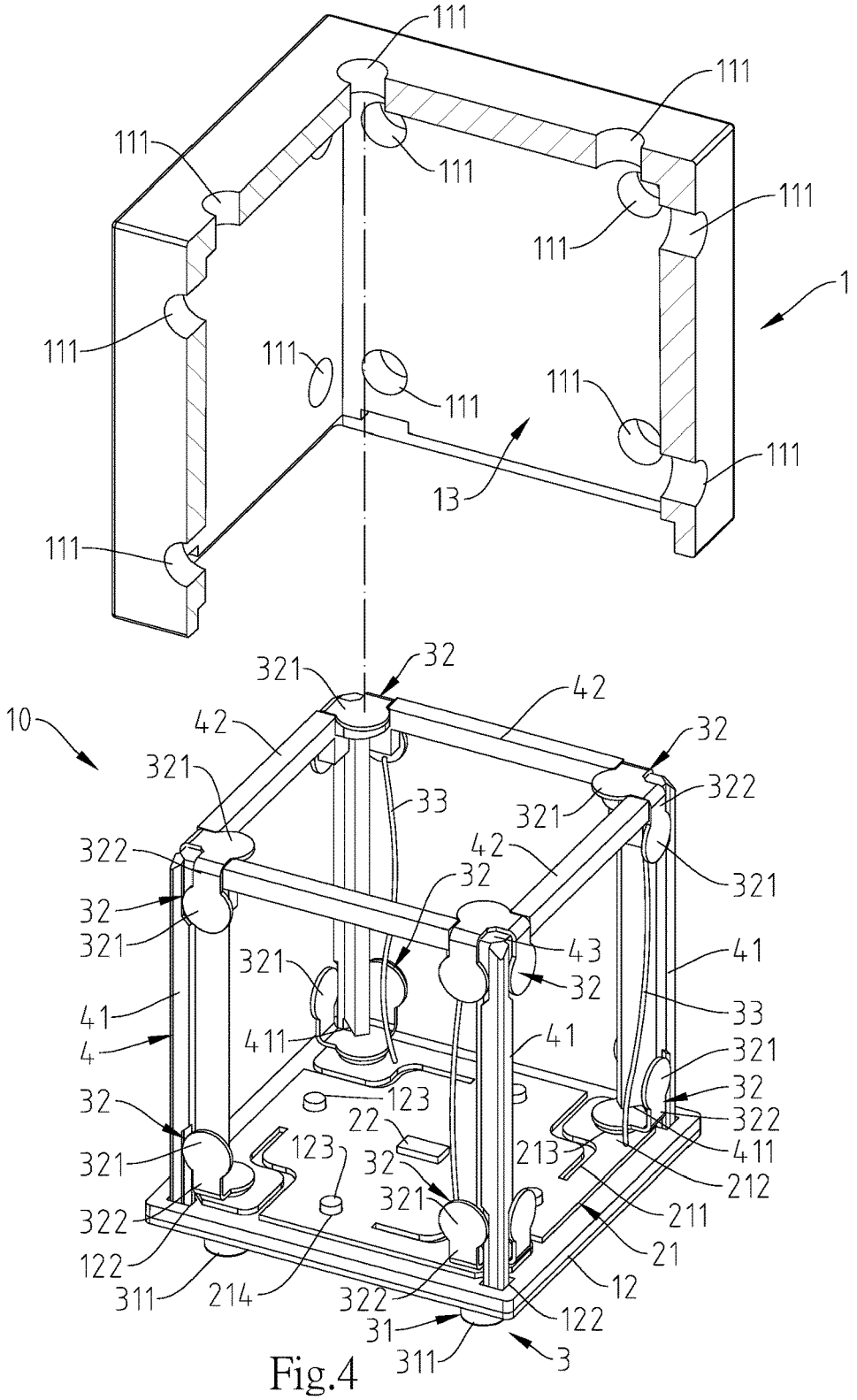
FIG. 4 is an exploded view of the magnetic positioning light-emitting toy block in accordance with the present invention.
Figure 5:
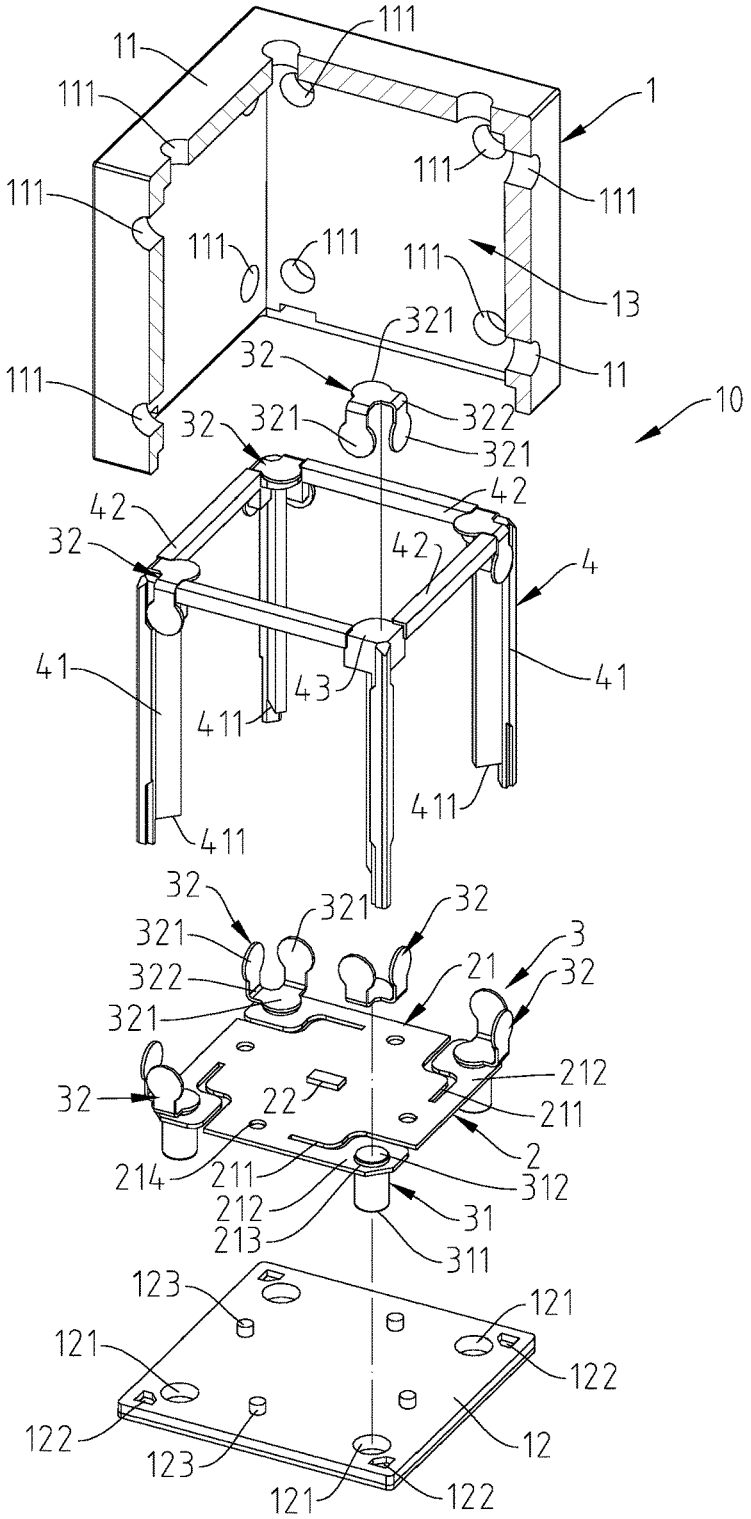
FIG. 5 is another exploded view of the magnetic positioning light-emitting toy block in accordance with the present invention.

Referring to FIGS. 1-5, a magnetic positioning light-emitting toy block 10 in accordance with the present invention is shown. The magnetic positioning light-emitting toy block 10 comprises a body 1, a light source 2, an electrical conduction mechanism 3 and a support frame 4.

The body 1 comprises a light transmissive body shell 11 shaped like a rectangular box, a cover panel 12 covering the light transmissive body shell 11, an accommodation chamber 13 defined in the light transmissive body shell 11, a plurality of plug holes 111 located on each of five sides of the light transmissive body shell 11, a plurality of positioning holes 121 cut through opposing top and bottom surfaces of the cover panel 12, and a plurality of locating grooves 122 and positioning rods 123 located on the bottom surface of the cover panel 12 and facing toward the accommodation chamber 13.

The light source 2 comprises an electrical substrate 21, and light-emitting device 22 electrically bonded to the electrical substrate 21. The electrical substrate 21 comprises a plurality of locating holes 214 respectively coupled to the positioning rods 123, a plurality of narrow, elongated, curved slots 211 respectively inwardly extended from four side edges thereof, a plurality of elastically deformable portions 212 respectively defined by the narrow, elongated, curved slots 211, and a plurality of connection holes 213 respectively located on the elastically deformable portion 212 corresponding to the positioning holes 121.

The support frame 4 is mounted in the accommodation chamber 13 inside the body 1, comprising a plurality of first support rods 41 respectively vertically fastened to the locating grooves 122 at the cover panel 12, a plurality of second support rods 42 respectively horizontally connected between each two adjacent first support rods 41, a positioning groove 43 located on the junction between each first support rod 41 and the respective connected two second support rods 42 and an escape groove 411 located on each first support rod 41 remote from the second support rods 42.

The electrical conduction mechanism 3 comprises a plurality of magnetic conducting columns 31 and a plurality of conducting plates 32. The magnetic conducting columns 31 each have opposing mating contact end 311 and connection end 312. The connection end 312 is inserted into one respective connection hole 213 of the electrical substrate 21 to protrude over the surface of the respective elastically deformable portion 212. The mating contact end 311 is inserted through one respective positioning hole 121. The conducting plates 32 are mounted in corners in the accommodation chamber 13 inside the body 1. Each conducting plate 32 comprises two conducting portions 321, and a connecting portion 322 connected between the two conducting portions 321. One conducting portion 321 of each conducting plate 32 is disposed adjacent to the electrical substrate 21 and electrically connected to the connection end 312 of the magnetic conducting column 31 so that the conducting plates 32 and magnetic conducting column 31 are electrically connected together. The other connecting portion 322 of each conducting plate 32 is disposed far from the electrical substrate 21 and connected to one respective positioning groove 43 of the support frame 4 and also electrically coupled to the electrical substrate 21 by a respective lead wire 33. After installation, the conducting portions 321 of the conducting plates 32 are respectively aimed at the plug holes 111 of the body 1 之.

Figure 6:
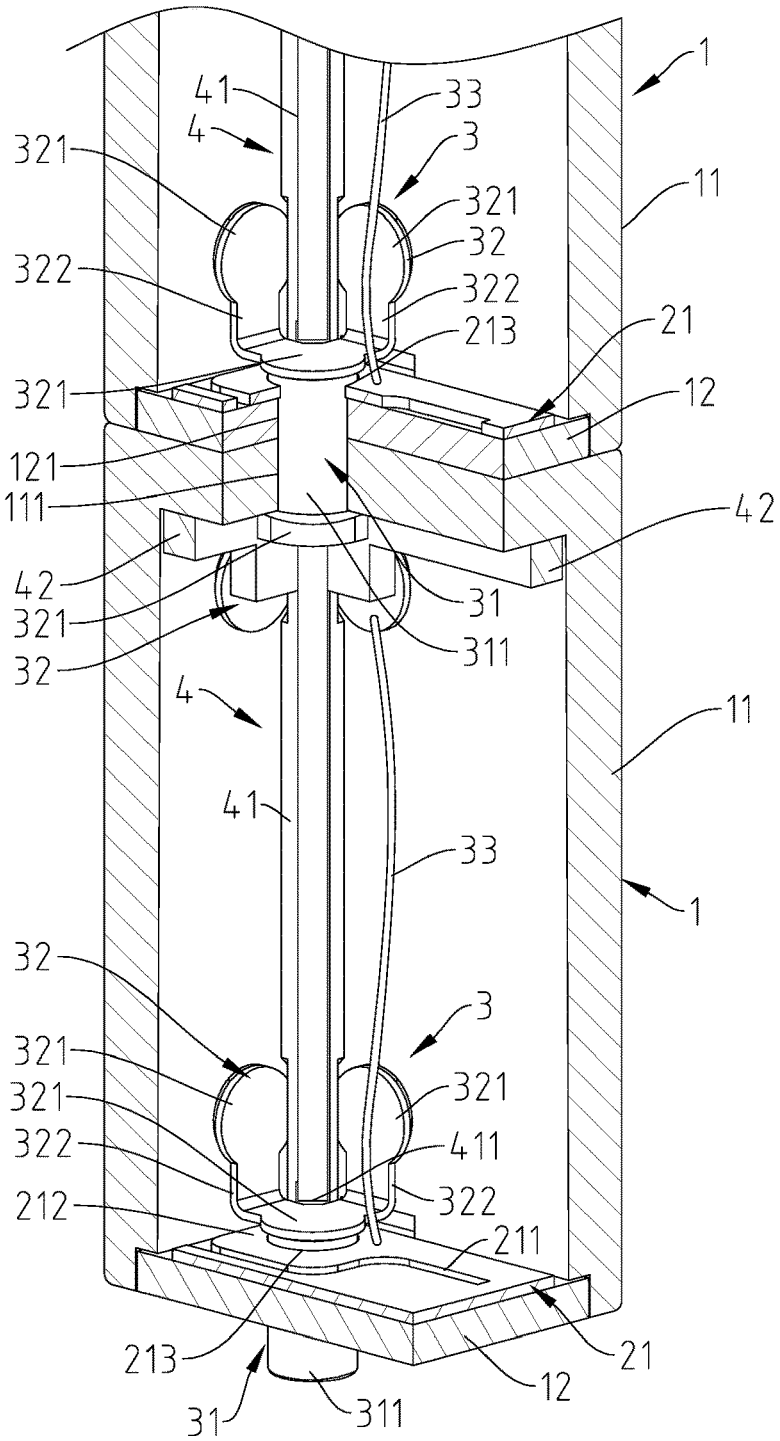
FIG. 6 is a schematic sectional elevational view illustrating two same magnetic positioning light-emitting toy blocks connected together.
Figure 7:
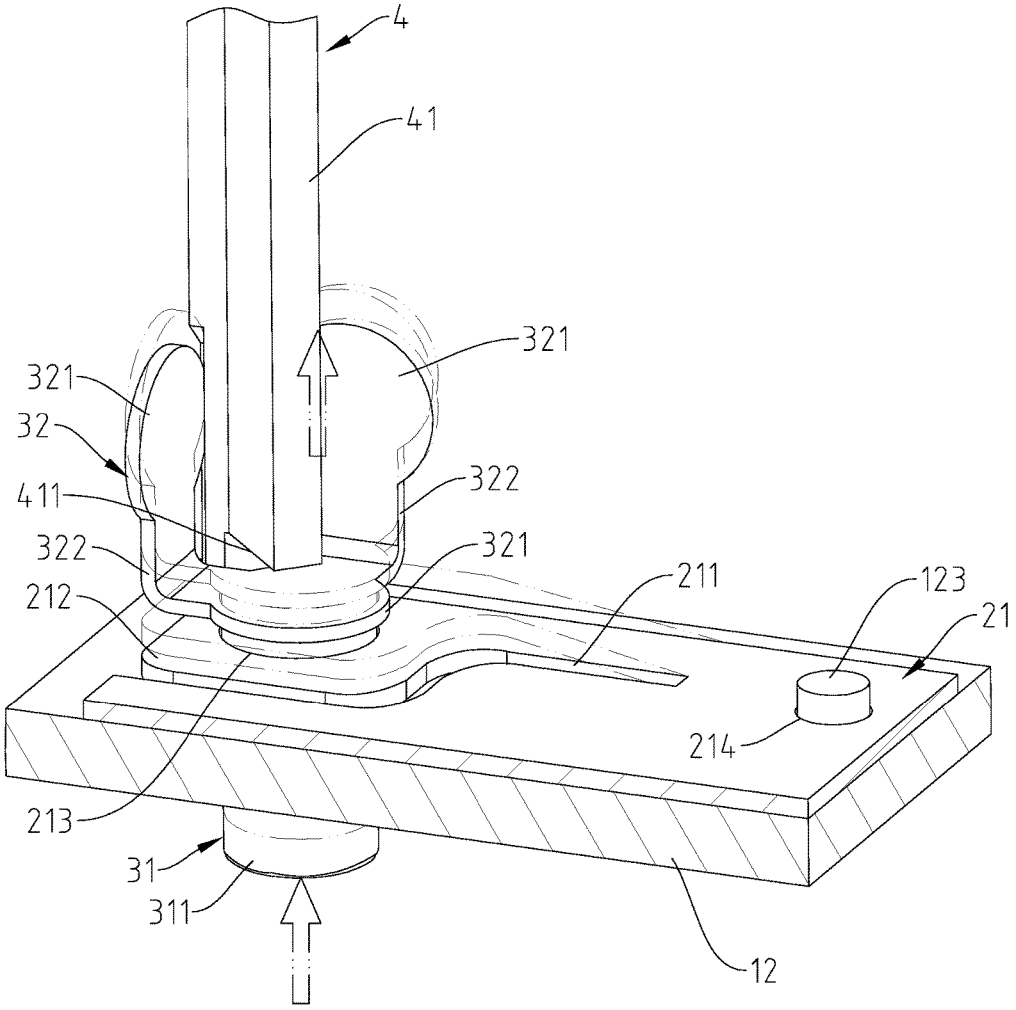
FIG. 7 is a schematic drawing illustrating an elastic displacement of the magnetic conducting column according to the present invention.

Referring to FIGS. 6 and 7, when connecting two same magnetic positioning light-emitting toy blocks 10, insert the mating contact ends 311 of the magnetic conducting columns 31 of one magnetic positioning light-emitting toy block 10 into the respective of the plug holes 111 of the body 1 of the other magnetic positioning light-emitting toy block 10, enabling the inserted magnetic conducting columns 31 to be secured to the respective conducting portions 321 of the other magnetic positioning light-emitting toy block 10, and thus, these two magnetic positioning light-emitting toy blocks 10 are secured together by magnetic attraction and electrically coupled together. In order to prevent vibration after connection, the outer diameter of the magnetic conducting columns 31 must fit the inner diameter of the plug holes 111. Further, in order to facilitate connection between two magnetic positioning light-emitting toy blocks 10, the invention has the magnetic conducting columns 31 be connected to the elastically deformable portions 212 of the electrical substrate 21, making the magnetic conducting columns 31 elastically retractable in direction toward the inside of the accommodation chamber 13.

Figure 8:
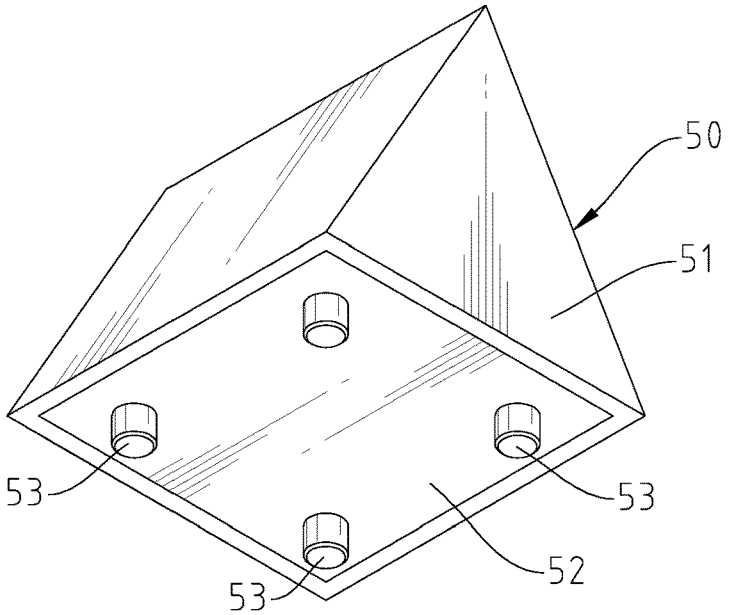
FIG. 8 is an elevational view of a terminal block in accordance with the present invention.
Figure 9:
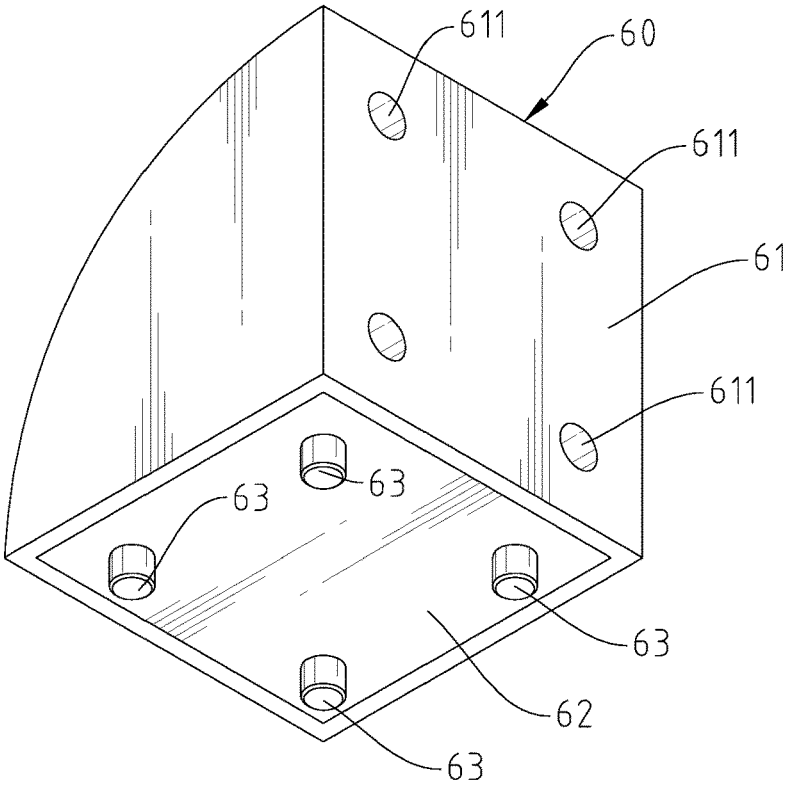
FIG. 9 is an elevational view of an alternate form of terminal block in accordance with the present invention.

Referring to FIGS. 8 and 9, the magnetic positioning light-emitting toy block can be made in the form of a terminal block 50 or 60. The body of the terminal block 50 shown in FIG. 8 comprises a triangular prism-shaped light transmissive body shell 51, and a rectangular cover panel 52 covered on the rectangular open side of the triangular prism-shaped light transmissive body shell 51. Further, the cover panel 52 has a plurality of magnetic conducting columns 53 suspended on the outside. The terminal block 60 shown in FIG. 9 comprises a sector prism-shaped light transmissive body shell 61, and a rectangular cover panel 62 covered on the rectangular open side of the sector prism-shaped light transmissive body shell 61. Further, the cover panel 62 a plurality of magnetic conducting columns 63 suspended on the outside. The light transmissive body shell 61 has plug holes 611 located on one rectangular side thereof.

Figure 10:
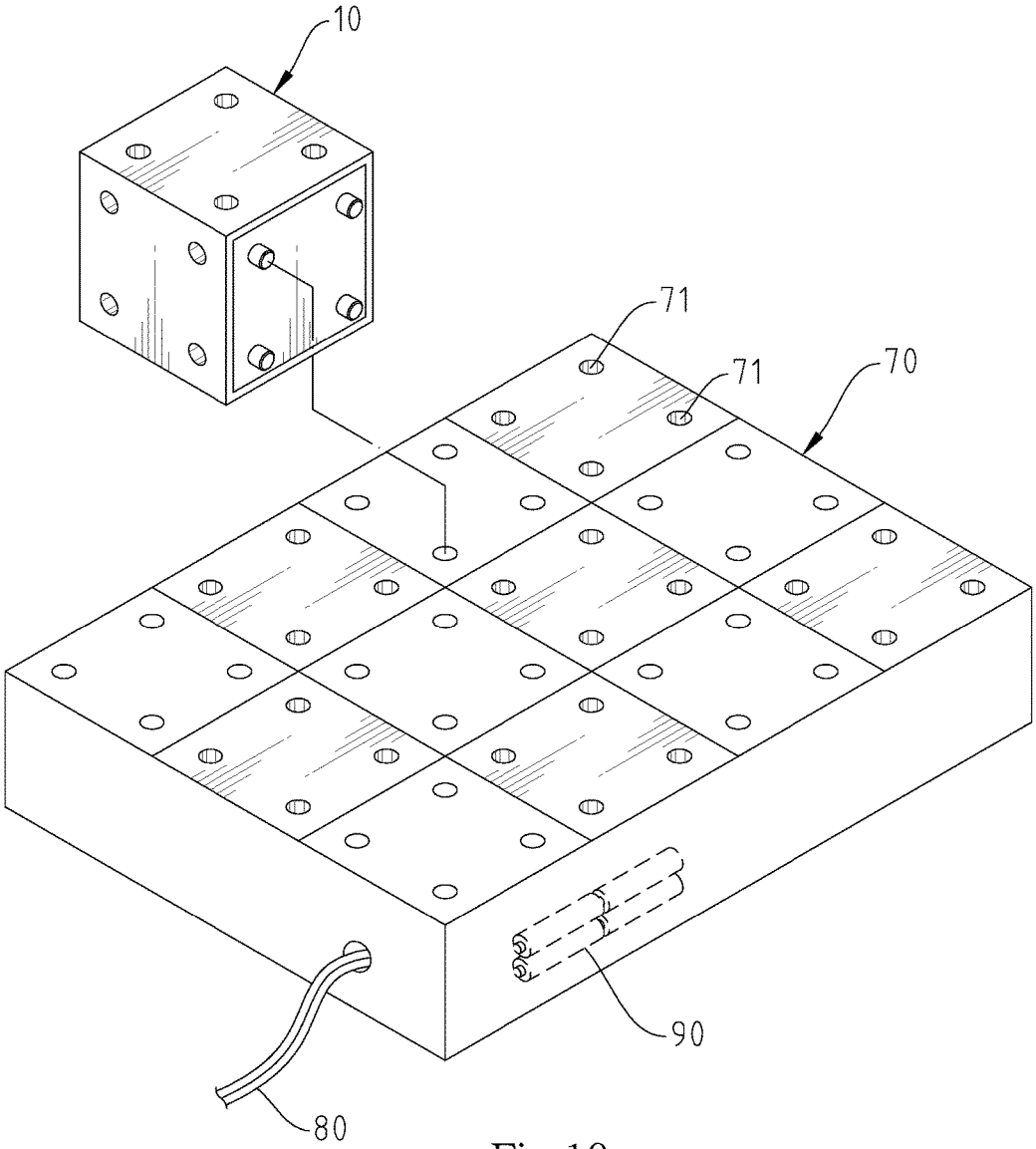
FIG. 10 illustrates the relationship between the magnetic positioning light-emitting toy block and a platform in accordance with the present invention.
Figure 11:
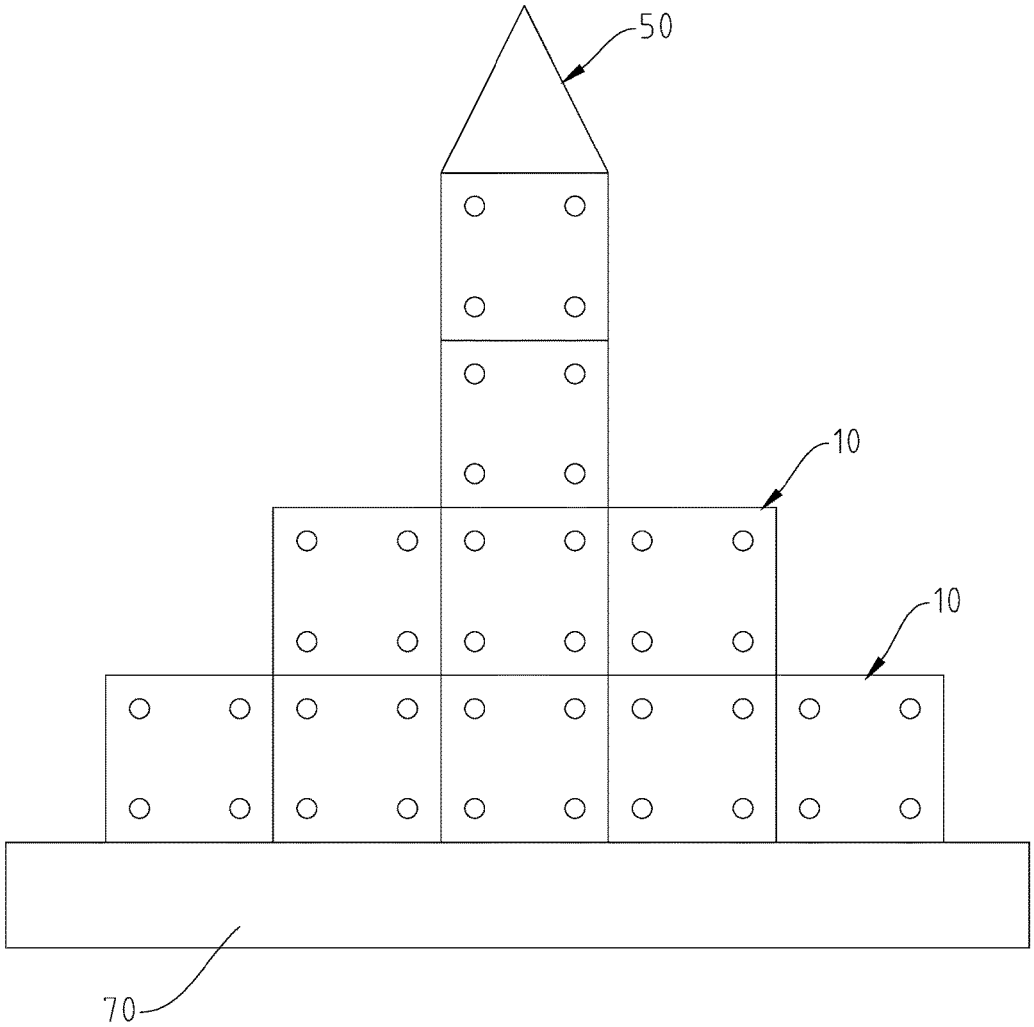
FIG. 11 is an applied view illustrating a toy construction built according to the present invention.

Referring to FIGS. 8, 10 and 11, in application, magnetic positioning light-emitting toy blocks 10 are mounted on a platform 70. The platform 70 provides a power cable 80 or is equipped with battery cells 90. Further, the platform 70 has a plurality of conducting holes 71. When inserting the magnetic conducting columns 31 of one magnetic positioning light-emitting toy block 10 into respective conducting holes 71 of the platform 70, the mounted magnetic positioning light-emitting toy block 10 is electrically coupled to the power cable 80 or battery cells 90.

What is claimed is:

1. A magnetic positioning light-emitting toy block, comprising:

a body comprising an accommodation chamber defined therein, a plurality of positioning holes located on one side thereof and a plurality of plug holes located on other sides thereof;

a light source mounted in said accommodation chamber of said body, said light source comprising an electrical substrate and a light-emitting device electrically coupled to said electrical substrate; and an electrical conduction mechanism comprising a plurality of magnetic conducting columns and a plurality of conducting plates, each said magnetic conducting column having one end thereof electrically connected to said electrical substrate of said light source and an opposite end thereof inserted through one respective said positioning hole of said body and extended out of said body, each said conducting plate comprising a conducting portion, said conducting plates being mounted in said accommodation chamber inside said body and electrically connected to said electrical substrate with the said conducting portions thereof respectively aligned with said plug holes of said body; and wherein said electrical substrate of said light source comprises a plurality of elastically deformable portions defined in said electrical substrate, and a connection is hole located on each said elastically deformable portion, said magnetic conducting columns of said electrical conduction mechanism each have two opposite ends thereof respectively terminating in a mating contact end and a connection end, each said connection end being fastened to one respective said connection hole, each said mating contact end being inserted through one respective said positioning hole;

wherein two same said magnetic positioning light-emitting toy blocks are connectable by inserting the said magnetic conducting columns of one said magnetic positioning light-emitting toy block into the respective said plug holes of the other said magnetic positioning light-emitting toy block, enabling the inserted said magnetic conducting columns to be connected to the said conducting plates of the other said magnetic positioning light-emitting toy block and electrically connected thereto; and the magnetic positioning light-emitting toy block further comprises a support frame mounted in said accommodation chamber of said body, said support frame comprising a plurality of first support rods respectively vertically disposed in said accommodation chamber adjacent to the respective said positioning holes, a plurality of second support rods respectively horizontally connected between each two adjacent said first support rods remote from said positioning holes and a positioning groove located on the junction between each said first support rod and the respective connected two said second support rods; and said conducting plates that are disposed in said accommodation chamber of said body remote from said electrical substrate are respectively positioned in said positioning grooves.

2. The magnetic positioning light-emitting toy block as claimed in claim 1, wherein said body comprises a light transmissive body shell and a cover panel covering said light transmissive body shell; said plug holes are arranged on each of multiple sides of said light transmissive body shell; said positioning holes are arranged on said cover panel; said electrical substrate of said light source is arranged on an inner surface of said cover panel.

3. The magnetic positioning light-emitting toy block as claimed in claim 1, wherein said electrical substrate of said light source comprises a plurality of narrow, elongated, curved slots respectively inwardly extended from peripheral edges thereof; said elastically deformable portions are respectively defined by the respective said narrow, elongated, curved slots.

4. The magnetic positioning light-emitting toy block as claimed in claim 1, wherein each said elastically deformable portion is respectively aligned with said positioning holes, and a predetermined number of said conducting plates are disposed in said accommodation chamber of said body adjacent to said electrical substrate and electrically connected to the said connection ends of said magnetic conducting columns.

5. The magnetic positioning light-emitting toy block as claimed in claim 1, wherein a predetermined number of said conducting plates are disposed in said accommodation chamber of said body remote from said electrical substrate and electrically connected to said electrical substrate by a respective lead wire.

* * * * *